United States Patent [19]

Budzich

[11] 4,358,294

[45] Nov. 9, 1982

[54] INLET THROTTLING VALVE OF GAS FUEL COMPRESSOR

[76] Inventor: Tadeusz Budzich, 80 Murwood Dr., Moreland Hills, Ohio 44022

[21] Appl. No.: 214,241

[22] Filed: Dec. 8, 1980

[51] Int. Cl.[3] ..... F17D 3/00

[52] U.S. Cl. ..... 48/191; 137/494

[58] Field of Search ..... 48/191; 137/494

[56] References Cited

U.S. PATENT DOCUMENTS 2,676,876 4/1954 Mosely ..... 48/191 X 3,023,093 2/1962 Hughes ..... 48/191

*Primary Examiner*—Richard V. Fisher

[57] ABSTRACT

A control valve automatically regulating the flow of gas fuel to the inlet of a gas fuel compressor to maintain the pressure in a gas fuel line, leading to an appliance, above a minimum predetermined level.

9 Claims, 1 Drawing Figure

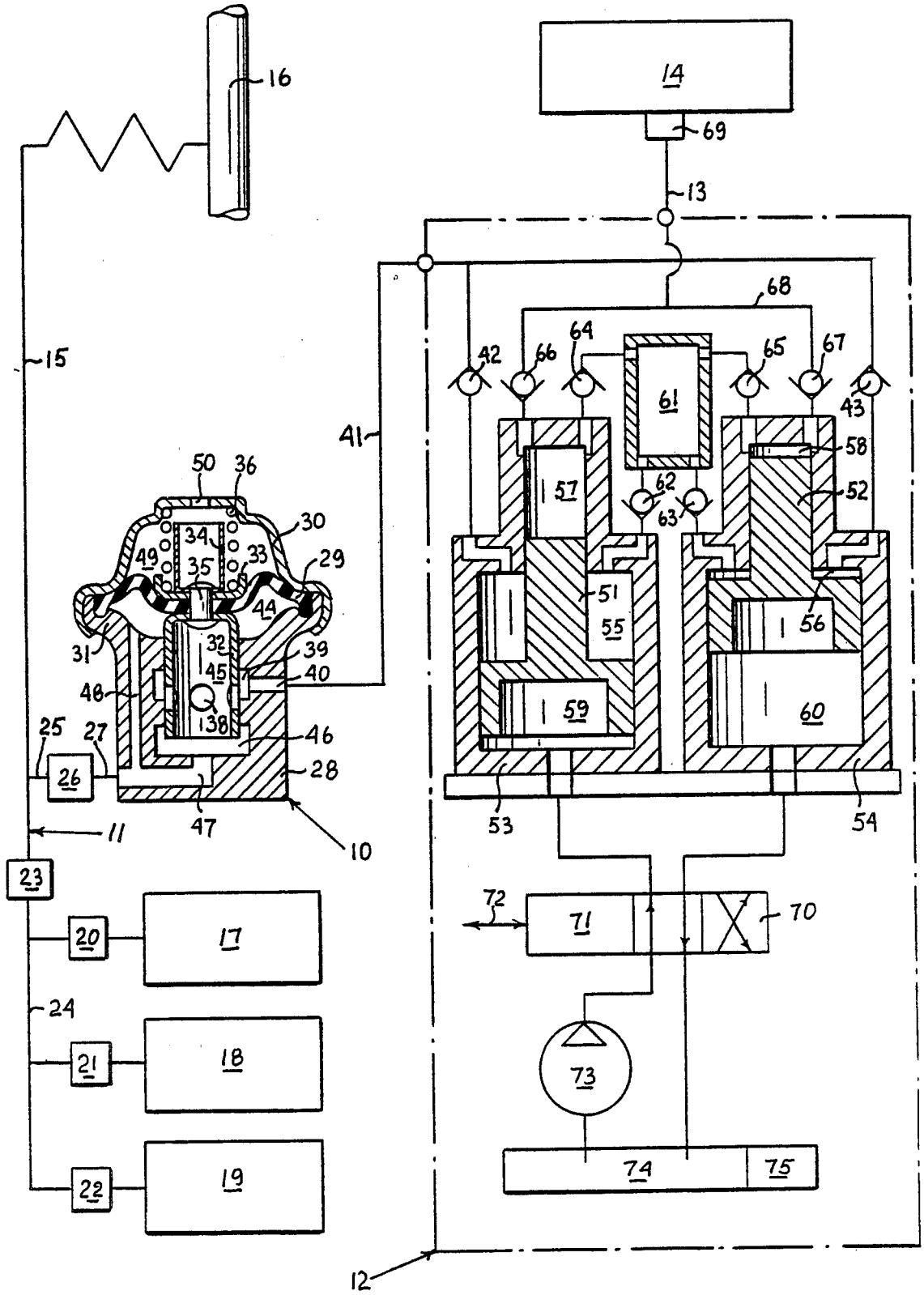
16
14
69
13
68
15
41
42
66
64
65
67
43
61
58
57
62
63
52
50
36
30
34
33
29
49
35
44
51
55
56
31
32
39
45
40
48
138
46
25
27
26
28
47
11
10
53
54
23
20
17
72
71
70
24
21
18
73
22
19
74
75
12

INLET THROTTLING VALVE OF GAS FUEL COMPRESSOR

BACKGROUND OF THE INVENTION

This invention relates generally to a gas fuel distribution system, supplying with gas fuel a number of appliances and a gas fuel compressor, storing the gas fuel under pressure in a suitable pressure vessel.

In more particular aspects this invention relates to a control valve, which regulates the flow of gas fuel to a gas fuel compressor, to maintain an uninterrupted flow of gas fuel to other appliances, at a certain minimum pressure level.

Gas fuel, for example methane, is supplied to individual houses from a main pipeline through a network of individual pipelines, which are of comparatively small diameter and the length of which may vary widely. The gas pressure in the main pipelines not only varies considerably from one location to another, but is also dependent on the rate, at which the gas is being used. The gas line, supplying with gas fuel an individual house, must have sufficient flow capacity, with main line at minimum pressure, to carry the maximum flow required by all gas appliances in the house at a certain minimum pressure level.

Methane gas, when compressed to say 2000 PSI and stored in a pressure vessel, provides a very desirable clean burning fuel for use in a conventional passenger car, with only small modifications required to the existing carburation system. Dual carburation systems are available, which permit use of methane and once the supply of methane is exhausted, permit switching the engine operation to conventional gasoline fuel. With the present shortages and price of gasoline and with an abundant supply of comparatively inexpensive natural gas, a passenger car, equipped with a dual carburation system and gas storage tanks, becomes very attractive, especially for purposes of short range commuting. In such service, with storage tanks charged with methane, the driver can commute to work, within say, thirty miles radius using methane fuel only, after each trip the methane storage tanks being recharged. Since a very large number of individual houses are connected to a natural gas supply, using it for heating and cooking purposes, by installing an individual gas compressing facility in individual houses, recharging of the methane storage tanks of a passenger car during the night becomes possible, using the domestic natural gas supply. Under these conditions each domestic natural gas supply becomes automatically an individual recharging station at which the passenger car can be recharged with methane gas and used for commuting. In such a system, with low main line pressure and all of the house gas appliances working, the additional flow requirements of the gas compressor might excessively lower the gas fuel pressure.

SUMMARY OF THE INVENTION

It is therefore a principal object of this invention to provide, in a domestic natural gas distribution system including gas appliances and a gas compressor, a control valve automatically regulating the flow of gas fuel to the gas compressor inlet, to maintain the pressure of the gas distribution system above a minimum predetermined level.

Another object of this invention is to provide a control valve which will cut off the gas flow to the gas compressor, once the gas pressure in a domestic gas distribution system drops below a certain predetermined level.

Briefly the foregoing and other additional objects of this invention are accomplished by providing a novel control valve for control of inlet pressure of a gas compressor, responsive to the gas fuel pressure in a domestic gas fuel distribution system, to control the rate of gas fuel flow into the compressor, to maintain the pressure in the domestic gas fuel distribution system above a certain predetermined pressure level as dictated by the minimum inlet pressure requirements of the appliances using gas fuel.

Additional objects of this invention will become apparent when referring to the preferred embodiment of the invention as shown in the single accompanying drawing and described in the following detailed description.

DESCRIPTION OF THE DRAWING

The SINGLE drawing shows a sectional elevation of the control valve of this invention with schematically shown gas fuel lines and appliances of a domestic gas fuel distribution system and with the gas fuel compressor shown diagrammatically.

DESCRIPTION OF THE PREFERRED EMBODIMENT

A control valve, generally designated as 10, is interposed between a domestic fuel distribution system, generally designated as 11 and a gas fuel compressor, generally designated as 12, supplying with compressed gas through line 13 a gas storage vessel 14. The domestic gas fuel distribution system 11 is connected by supply line 15 with a main gas line 16, which supplies gas fuel under pressure. The distribution system 11 consists of a furnace 17, a water heater 18 and a cooking range 19, all provided with suitable pressure regulators 20, 21 and 22, supplied with gas fuel under pressure through a gas meter 23 and line 24.

The control valve 10 is connected to supply line 15 by line 25, gas meter 26 and line 27. The control valve 10 comprises a housing 28, provided with a diaphragm 29, secured in position by a cover 30. Cylindrical end of the cover 30, suitably deformed over a flange 31 of the housing 28, maintains in sealing engagement enlarged rim of the diaphragm 29. A sleeve 32, a spring guide 33 and a stop 34 are centrally secured to the diaphragm 29 by a rivet 35. A control spring 36 is interposed between the spring guide 33 and internal surface of the cover 30. The sleeve valve 32 is slidably guided in sealing engagement in a bore provided in the housing 28. The sleeve valve 32 has throttling ports 38 cooperating with annular space 39, which is connected by port 40 and line 41 with inlet check valves 42 and 43 of the compressor 12. The sleeve valve 32 protrudes with one end into space 44, while the other end with internal passage 45 communicates with an inlet chamber 46, which is connected through port 47, line 27, gas meter 26 and line 25 with supply line 15. Port 47 is also connected by passage 48 with space 44. Space 49, contained between the diaphragm 29 and the cover 30, is connected through port 50 with atmospheric pressure.

Pistons 51 and 52 of the compressor 10, slidably guided in cylinders 53 and 54, define first stage compression chambers 55 and 56, second stage compression chambers 57 and 58 and oil chambers 59 and 60. The first stage compression chambers 55 and 56 are connected through check valves 62 and 63 with an intercooler chamber 61 and through suction check valves 42 and 43 with port 40 of the control valve 10. The second stage compression chambers 57 and 58 are connected through check valves 64 and 65 with the intercooler chamber 61 and through discharge check valves 66 and 67 and lines 68 and 13 and a disconnect coupling 69 to the storage vessel 14. Oil chambers 59 and 60 are sequentially connected by a direction control valve 70, operated by an actuator 71 in response to control signal 72, either to a fluid power pump 73 or a reservoir 74, which might be provided with a negative pressure chamber 75.

With the appliances 17, 18 and 19 working, the resistance to flow of gas fuel in supply line 15 results in a pressure drop. The size of supply line 15 is so selected that with minimum pressure in line 16 and maximum pressure drop in supply line 15, the pressure in line 24, upstream of pressure regulators 20, 21 and 22, will be maintained above a certain minimum pressure level, at which the appliances 17, 18 and 19 can work at rated output. At gas pressures lower than this minimum level the heat output of the appliances will reduce, until a pressure level is reached, at which the appliances will cease to function. With all of the appliances working, the additional pressure drop in supply line 15, due to the inlet flow requirement of gas compressor 12, might bring the gas pressure, upstream of pressure regulators 20, 21 and 22, below the critical level. This condition is prevented by action of the control valve 10. The sleeve valve 32 is shown in an equilibrium position, in which the throttling action of throttling ports 38, in respect to edge of annular space 39, will regulate at port 40 the inlet pressure of the gas compressor 12, to reduce the inlet flow requirement of the gas compressor 12 to a level, at which the gas pressure in line 24 will be automatically maintained above a certain minimum pressure level, as required by the appliances 17, 18 and 19. This control action is accomplished in the following way. The pressure in supply line 15, conducted by port 47 to the inlet chamber 46, reacts on the cross-sectional area of the sleeve valve 32 tending to move it upward. This force is supplemented by the gas pressure conducted by passage 48 to space 44 reacting on the net effective area of the diaphragm 29. Therefore the diaphragm 29 on one side is subjected, on its total effective area, to the gas pressure, generating a force which is opposed only by the biasing force of the control spring 36, since the other side of the diaphragm 29 is vented to atmospheric pressure. With drop in pressure in supply line 15 the sleeve valve 32 moves downwards, gradually restricting with throttling ports 38 the gas flow to the gas compressor 12, until a position is reached, at which the communication between supply line 15 and the gas compressor 12 is completely cut off. With gas pressure in supply line 15 reaching a specific higher level the diaphragm 29 will move all the way up, lifting the sleeve valve 32 and engaging the cover 30 with the stop 34. In this position minimum resistance to gas flow is provided through the control valve 10. Within the controlling range of the control valve 10 each specific pressure level will generate a specific force on the diaphragm 29, corresponding to a specific deflection of the control spring 36 and therefore also corresponding to a specific position of sleeve valve 32. Therefore, by regulating gas flow into the gas compressor 12, the control valve 10 will automatically maintain the gas pressure in supply line 15 above a minimum preselected level, equivalent to the preload of the control spring 36.

The gas compressor 12 is of a double acting type one of the pistons being subjected to the discharge stroke while the other is subjected to the suction stroke. When the direction of the piston is being reversed small pressure fluctuations will take place at the compressor inlet. Those small fluctuations can be easily attenuated by the use of a suitable decoupling device, positioned for example between the compressor 12 and the control valve 10. For better synchronization the pistons of the gas compressor may be mechanically connected, while still being operated by the power derived from the system pump 73. The motion of the compressor pistons is controlled by the four way valve 70 through the actuator 71, which may respond to the position of compressor pistons, gas or pump pressure, or to any type of timing device. In a well known manner the gas fuel in the first stage compression chamber, at compressor inlet pressure, is compressed and transferred through the check valve 62 to the intercooler chamber 61, from which it supplies at intermediate gas pressure, through the check valve 65, the second stage compression chamber 58. The compressed gas from the second stage compression chamber 57 is directly transferred through the discharge check valve 66, line 13 and the coupling 69 to the storage vessel 14. Once the piston 51 will reach the end of its discharge stroke, the piston 52, then at the end of its suction stroke, connected to the source of hydraulic pressure by the four way valve 70, will start moving upwards during its discharge stroke. The pistons of the gas compressor 12 during suction stroke will move downward subjected to negative pressure developed in the reservoir 74 by negative pressure chamber 75 and also subjected to the intermediate pressure developed in the intercooler chamber 61. By varying the compressor inlet pressure, delivered to the first stage compression chambers 55 and 56, the quantity of gas being compressed and therefore the quantity of the gas delivered to the compressor from supply line 15 can be effectively regulated, since the weight of the compressed gas is directly proportional to the absolute gas pressure at the compressor inlet check valves 42 and 43. Reduction in inlet pressure will reduce compressor delivery, but will not adversely affect the basic compression cycle of the compressor. For example, with the furnace 17 and the water heater 18 working and the cooking range 19 disconnected, the gas compressor 12 will automatically supply, depending on the pressure in line 16, at least the maximum gas flow, equivalent to the maximum gas flow required by the cooking range 19. Since the furnace 17 is basically an on/off device, working intermittently, with furnace 17 not working the gas compressor 12 will automatically compress a quantity of gas equivalent to the rate of maximum flow capacity of the furnace 17 and the cooking range 18. Therefore, the control valve 10 will automatically regulate the pressure at the inlet of the compressor 12 to permit the maximum rate of gas compression, which will still not lower the pressure in the supply line 15 below a certain minimum predetermined pressure level, as dictated by the minimum gas pressure level required for the rated operation of the appliances 17, 18 and 19.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A gas fuel supply system comprising means supplying gas fuel, appliance means operable above a certain predetermined minimum fuel pressure level connected to said means supplying gas fuel, a gas fuel compressing means connected to said means supplying gas fuel, and gas fuel flow control means interposed between said means supplying gas fuel and said gas fuel compressing means, said fuel flow control means having means operable to progressively vary the quantity of gas fuel flow between said means supplying gas fuel and said gas fuel compressing means to maintain the pressure at said appliance means above said certain predetermined minimum pressure level.

2. A gas fuel supply system as set forth in claim 1 wherein said fuel flow control means includes gas fuel throttling means having means responsive to gas pressure in said means supplying gas fuel.

3. A gas fuel supply system as set forth in claim 2 wherein said gas fuel throttling means includes force generating means operable to generate force proportional to pressure in said means supplying gas fuel, and spring biasing means opposing said force generating means.

4. A gas fuel supply system as set forth in claim 1 wherein said gas fuel flow control means includes means operable to vary gas inlet pressure of said gas fuel compressing means.

5. A gas fuel supply system as set forth in claim 1 wherein said gas fuel flow control means includes shut-off means operable to shut off the gas flow between said means supplying gas fuel and said gas fuel compressing means when the pressure in said means supplying gas fuel drops to said certain predetermined minimum level.

6. A gas fuel supply system comprising means supplying gas fuel, appliance means connected to said means supplying gas fuel and operable above a certain predetermined minimum gas fuel pressure level, a gas fuel compressing means connected to said means supplying gas fuel, and control means operable to vary the mass of said gas fuel being compressed per unit time by said gas fuel compressing means to maintain pressure in said means supplying gas fuel above said predetermined minimum pressure level.

7. A gas fuel supply system as set forth in claim 6 wherein said control means has means operable to vary gas inlet pressure of said gas fuel compressing means.

8. A gas fuel supply system as set forth in claim 6 wherein said control means has gas fuel pressure throttling means interposed between said means supplying gas fuel and said gas fuel compressing means.

9. A gas fuel supply system as set forth in claim 6 wherein said control means includes shut-off means operable to shut off the gas flow between said means supplying gas fuel and said gas fuel compressing means when the pressure in said means supplying gas fuel drop to said certain predetermined minimum level.

* * * * *